US008136785B1

(12) United States Patent
Polster

(10) Patent No.: US 8,136,785 B1
(45) Date of Patent: Mar. 20, 2012

(54) DEVICE TO READ IN BED OR WHEN RECLINING

(75) Inventor: John Christopher Polster, Woodstock, IL (US)

(73) Assignee: John Christopher Polster, Woodstock, IL (US)

( * ) Notice: Subject to any disclaimer, the term of this patent is extended or adjusted under 35 U.S.C. 154(b) by 0 days.

(21) Appl. No.: 13/009,504

(22) Filed: Jan. 19, 2011

(51) Int. Cl.
*A47B 65/00* (2006.01)

(52) U.S. Cl. ..... 248/446; 248/444.1; 248/445

(58) Field of Classification Search ..... 248/441.1, 248/444, 444.1, 450, 446, 445
See application file for complete search history.

(56) References Cited

U.S. PATENT DOCUMENTS

| | | | | |
|---|---|---|---|---|
| 3,272,183 | A * | 9/1966 | Craighead et al. | 248/453 |
| 4,163,497 | A * | 8/1979 | McEwen | 211/11 |
| 4,685,647 | A * | 8/1987 | Calhoun | 248/444.1 |
| 7,568,674 | B2 | 8/2009 | Polster | |
| 2010/0219322 | A1 * | 9/2010 | Neves Moreira | 248/450 |

* cited by examiner

*Primary Examiner* — Ramon Ramirez
(74) *Attorney, Agent, or Firm* — Adam K. Sacharoff

(57) ABSTRACT

In accordance with the aspects of the present invention, an improved book holder for reading in bed is disclosed. The present invention includes a base panel, back panel, central slotted unit and moveable plexiglass plate rectangular in shape. The plexiglass includes a windowed region such that when using the invention with an e-book reader, the controls of the e-book reader can be accessed through the windowed region.

3 Claims, 3 Drawing Sheets

DEVICE TO READ IN BED OR WHEN RECLINING

FIELD OF THE INVENTION

The present invention relates to book stands, and more particularly to those used when reading in bed or reclining.

BACKGROUND OF THE INVENTION

This inventor builds upon Applicant's previous invention now U.S. Pat. No. 7,568,674, which is incorporated herein by reference. As previously noted people spend a lot of time reading in bed and suffering from muscle fatigue in the arms and hands, some of which may be due to medical conditions, preventing the user from holding a book upright for extended periods. In the late 1980s the inventor created a device which rests on the abdomen of the reader, allowing their arms and hands to be rested, and does not require installation of the device into the wall, ceiling or bed.

Book stands are currently available in a variety of shapes and sizes. Current stands have a number of drawbacks, particularly those designed for reading in bed. These must typically be affixed to the bed or a nearby wall, and involve metal "arms" which hover over the reader. These suffer from the difficulty of installation, are bulky and unsightly, and occupy excessive space, are difficult to adjust, and cannot support a variety of sizes of books or reading materials, especially larger books.

The user of the present invention rests the invention on her chest or abdomen, inserts the open book between the plexiglass plate and the back panel described herein below, and reads "through" the plexiglass, including the top edge thereof, to see the printed material. The plate is not so large as to cover the entire printed page(s), reducing the size and weight of the invention and making it highly portable and storable.

SUMMARY OF THE INVENTION

In accordance with the aspects of the present invention, an improved book stand, portable and not affixed to any other structure, is disclosed. The present invention includes a flat base board which rests horizontally, a vertical back board attached thereto which supports the back of the upstanding book, a slotted base unit, which supports the bottom of the book and which contains slots, into any one of which slots rests the plexiglass member which supports the front of the book or other reading material. The plexiglass member is a low shield which can be read "through" the bottom edge of which is placed into one of the slots so that the plexiglass is held upright. The device can be made of wood, plastic, metal or other rigid material, except for the shield, which can be made of glass, plastic or other clear material.

BRIEF DESCRIPTION OF THE DRAWINGS

The foregoing aspects an many of the attendant advantages of this invention will become more readily appreciated as the same become better understood by reference to the following detailed description, when taken in conjunction with the accompanying drawing and FIGURES, wherein.

DETAILED DESCRIPTION OF THE PREFERRED EMBODIMENT

Figure 1:
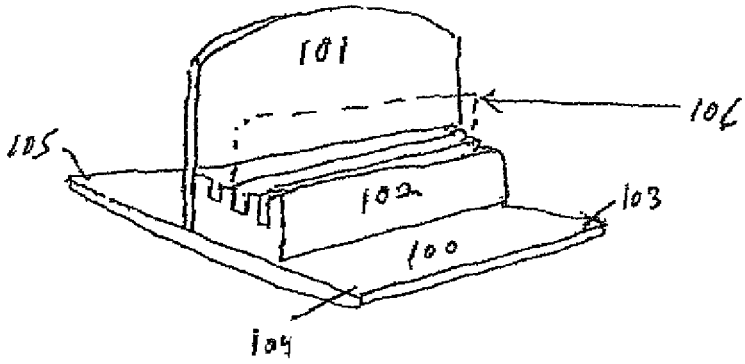
FIG. 1 is a perspective view of the invention as it may appear to a reader who rests the invention on his abdomen while reclining in bed. The dotted line (in ALL FIGURES) depicts the low plexiglass shield which reduces the bulk of the invention because of its low profile. The corners of the shield, while appearing square, are actually slightly rounded off for the comfort of the reader when handling the same.
Figure 2:
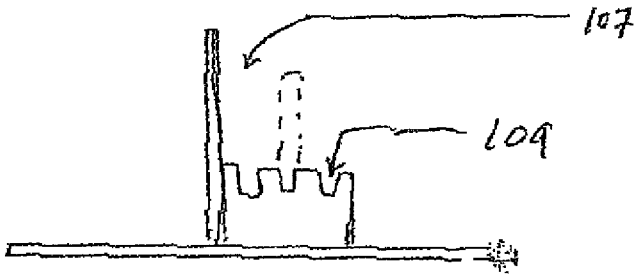
FIG. 2 is a side plan view of the invention, showing the slots in which the clear shield rests so that the invention can accommodate any size book.
Figure 3:
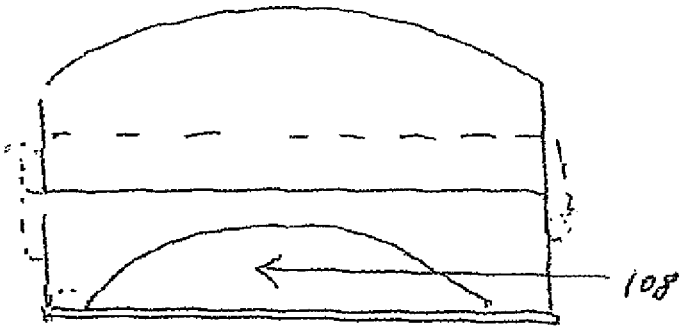
FIG. 3 is a frontal plan view, showing the hollowed arch in the underside of the base unit, which hollow area lightens the weight of the invention and makes it easier to lift and handle.
Figure 4A:
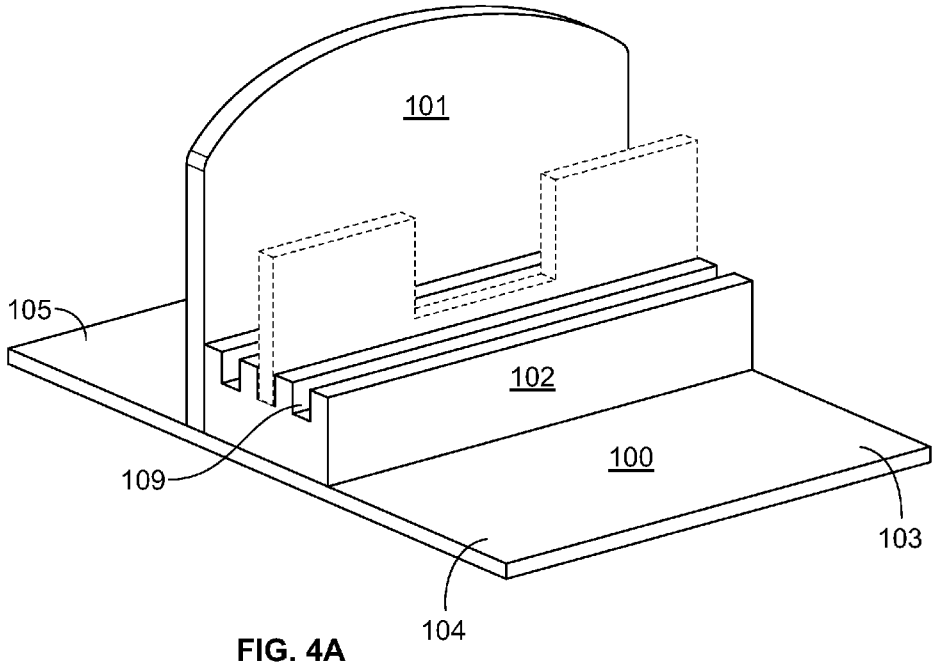
FIG. 4*a* is a perspective view of the invention as it may appear to a reader who rests the invention on his abdomen while reclining in bed with the improved plexiglass shield with window.
Figure 4B:
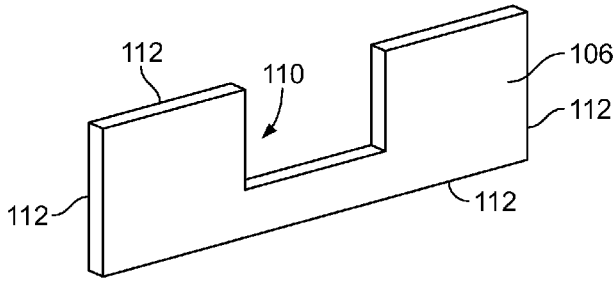
FIG. 4*b* is a frontal view of the plexiglass shield shown in FIG. 4*a*.
Figure 5A:
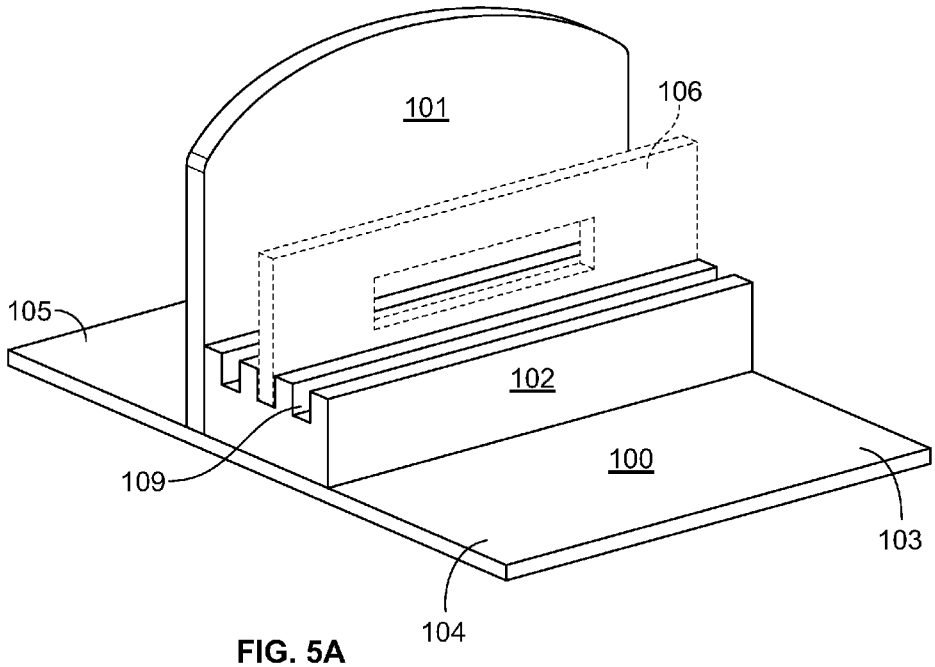
FIG. 5*a* is a perspective view of the invention as it may appear to a reader who rests the invention on his abdomen while reclining in bed with an improved plexiglass shield with window.
Figure 5B:
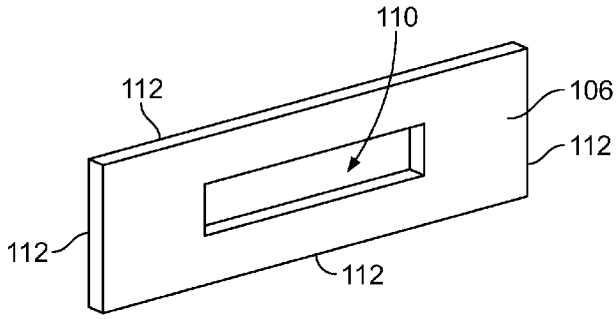
FIG. 5*b* is a frontal view of the plexiglass shield shown in FIG. 4*a*.

The present invention is an improvement to a book holder or stand used for reading in bed or otherwise in a reclining position. By way of overview and with reference to FIGS. 1-3, one presently preferred embodiment of the present invention includes the following attached pieces: the base panel 100 and the back panel 101. The base panel includes corners, three of which are shown, 103, 104, 105.

The Central Unit 102 is a solid piece of wood or plastic, or a hollowed piece of metal in one presently preferred embodiment, containing slots 109, into which the bottom edge of a plexiglass member 106 is inserted. The transparent rectangular piece may be inserted into any one of the slots in the base unit, accommodating a book or magazine of any size. The open book or a e-book rests upon the base unit between the transparent rectangular piece and the back panel in the area of 107. The reader then reads "through" the transparent piece, including its top edge, which does not materially obstruct the user's view of the text. One notable issue with the use of transparent rectangular piece of material or plexiglass member is when using an e-book, the controls or touch screen are often behind or partially behind the plexiglass member, making access to the controls more difficult. To overcome these difficulties, the below embodiments help to solve this issue.

The plexiglass member 106 may also include an windowed region 110 positioned in the member 106 such that the windowed region 110 is either opened to one or more of the terminate edges 112 of the plexiglass member 106 (being co-terminate with one or more edges) or positioned such that the windowed region 110 is entirely surrounded by the edges 112 of the plexiglass member 106 (being non-co-terminate with the edges of the plexiglass member). As noted above, the windowed region 110 now permits the book holder to be used more easily with different types of electronic e-book readers by allowing the user to manipulate the controls on the e-book, such as a touch screen or activity buttons. Since e-book readers have various activity or action buttons (such as to electronically move pages or search and order books) access to these buttons must still be provided. The plexiglass member will help restrain the e-book on the central unit which permits complete access through the window to the buttons on the e-book readers and the unit itself still elevates the e-book to a more comfortable reading level.

The central unit is hollowed out in an arched or open "tunnel" where the central unit is connected to the base panel as depicted in 108. This tunnel area runs from the front to the back of the base unit, reducing the weight of the invention.

The clear shield is not attached to the central unit, so that it can be used to adjust the invention to a size of different books or other reading materials. Instead the clear shield simply rest in one of the slots such as 109.

I claim:

1. A book holder comprising:

a base panel which lies flat upon the user's abdomen, a back panel attached perpendicular to said base panel, a central unit attached to the base and back panels at the intersection thereof wherein said central unit is slotted at the top;

a plexiglass or other clear transparent shield resting in a slot in the central unit, the plexiglass or other clear transparent shield terminates along periphery edges, and the plexiglass or other clear transparent shield further having a windowed region defined therein, and wherein an e-book reader is restrained as said e-book reader rests upon the top of the central unit and is positioned between the back panel and the plexiglass or other clear transparent shield and whereby a front portion of the e-book reader containing controls is accessible through said windowed region.

2. The book holder of claim 1, wherein the windowed region is positioned such that an edge of the windowed region is co-terminate with one or more edges of the plexiglass or other clear transparent shield.

3. The book holder of claim 1, wherein the windowed region is positioned such that all edge of the windowed region are non co-terminate with the edges of the plexiglass or other clear transparent shield.

* * * * *